US006812172B2

(12) United States Patent
Hayes et al.

(10) Patent No.: US 6,812,172 B2
(45) Date of Patent: Nov. 2, 2004

(54) MICRODENIER FABRIC HAVING ENHANCED DYED APPEARANCE

(75) Inventors: Heather J. Hayes, Chesnee, SC (US); Crystal A. Garner, Greer, SC (US); Kirkland W. Vogt, Simpsonville, SC (US); Kaushal Gandhi, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 257 days.

(21) Appl. No.: 10/074,536

(22) Filed: Feb. 12, 2002

(65) Prior Publication Data

US 2003/0157860 A1 Aug. 21, 2003

(51) Int. Cl.[7] ..... D04H 3/00; D04H 3/16; D06P 3/82

(52) U.S. Cl. ..... 442/340; 442/335; 442/347; 442/351; 442/361; 8/115.54; 8/529; 8/531

(58) Field of Search ..... 442/340, 347, 442/351, 361, 121, 335; 8/115.54, 529, 531

(56) References Cited

U.S. PATENT DOCUMENTS 4,008,344 A * 2/1977 Okamoto et al. ..... 428/374
4,353,706 A * 10/1982 Burns et al. ..... 8/114.6
4,367,070 A * 1/1983 Hayashi et al. ..... 8/114.6
4,415,331 A 11/1983 Dusenbury et al. ..... 8/114.6
5,225,263 A 7/1993 Baravian et al. ..... 428/95
5,364,417 A 11/1994 Wenstrup et al. ..... 8/592
5,899,785 A 5/1999 Groten et al. ..... 442/334
5,970,583 A 10/1999 Groten et al. ..... 19/296

OTHER PUBLICATIONS

Tortora, Phyllis G. Understanding Textiles 4$^{th}$ Edition. Macmillan Publishing Company, New York. 1992. pp 421–422.*

* cited by examiner

*Primary Examiner*—Cheryl A. Juska
*Assistant Examiner*—Jenna-Leigh Befumo
(74) *Attorney, Agent, or Firm*—Terry T. Moyer; Charlotte C. Wilson

(57) ABSTRACT

In a preferred embodiment, the present process involves subjecting a fabric comprised of conjugate yarns to an acidic treatment, which degrades a portion of one component of the conjugate yarns and to dyeing. The acid treatment, given certain reaction kinetics, removes a portion of the polyamide element of the conjugate filament. The at least partial removal of the polyamide component results in a fabric has enhanced dyed appearance, especially when dyed a dark shade. In an alternate embodiment, the fabric may also be treated with a basic solution to improve its moisture transport properties.

35 Claims, 1 Drawing Sheet

MICRODENIER FABRIC HAVING ENHANCED DYED APPEARANCE

TECHNICAL FIELD

This disclosure relates to a treated fabric that is comprised of splittable conjugate fibers and to a process for modifying such a fabric to enhance its dyed appearance. More specifically, the present invention relates to a consolidated nonwoven fabric containing continuous filaments comprised of polyester and polyamide components, in which at least portions of the polyamide component have been removed. The process used to remove portions of the polyamide component involves treating the fabric with acid. The result is a dyed fabric that has a deeper depth of shade and that has a brighter hue, as compared to the untreated fabric. Contemplated end uses of such a dyed fabric are also provided.

BACKGROUND

Microdenier fabrics are traditionally created by mechanically or chemically splitting a conjugate fibers into its elementary filaments. Microdenier fabrics, particularly those having polyamide and polyester components, are traditionally difficult to dye, often resulting in a fabric with a "frosty" appearance. This appearance is due to the inability to effectively dye the polyamide component.

As will be discussed herein, the present process is applicable to any conjugate fibers that includes a polyamide as one of its components. The present process improves the dyed appearance of fabrics of any construction (woven, knit, or nonwoven) that are comprised of microdenier yarns that result from splitting conjugate multi-component yarns. Although the benefits of this process are readily apparent on a specific nonwoven fabric that will be discussed in detail herein, it should be understood that it is equally applicable to woven or knitted microdenier fabrics created from splittable yarns.

Nonwovens are known in the industry as an alternative to traditional woven or knit fabrics. To create a nonwoven fabric, a filament web must be created and then consolidated. Staple fibers are formed into a web through the carding process, which can occur in either wet or dry conditions. Alternatively, continuous filaments, which are formed by extrusion, may be used in the formation of web. The web is then consolidated, and/or bonded, by means of needle-punching, thermal bonding, chemical bonding, or hydroentangling. A second consolidation treatment may also be employed.

A preferred substrate for the present disclosure is a nonwoven formed of continuous splittable filaments that are extruded as a web and then consolidated. The continuous conjugate filaments are obtained by means of a controlled spinning process. The continuous filaments have the following characteristics: (1) the continuous filaments are comprised of at least two elementary filaments and at least two different fiber types; (2) the continuous filaments are splittable along at least a plane of separation between elementary filaments of different fiber types; (3) the continuous filaments have a filament number (that is, titer or yarn count) of between 0.3 dTex and 10 dTex; and (4) the elementary filaments of the continuous filament have a filament number between 0.005 dTex and 2 dTex. Simply put, the nonwoven fabric can be described as a nonwoven fabric of continuous microfilaments. Such a fabric is described in U.S. Pat. Nos. 5,899,785 and 5,970,583, both to Groten et al., each of which is incorporated herein by reference.

A wide range of synthetic materials may be utilized to create the elementary filaments of the continuous conjugate filaments. However, the present invention is intended to improve the characteristics of fabrics that contain elementary filaments of different fiber types (e.g., polyesters and polyamides). As such, the group of polymer materials forming the elementary filaments may be selected from among the following groups: polyester and polyamide; polyolefin and polyamide; polyurethane and polyamide; polyester, polyolefin, and polyamide; aliphatic polyester and aromatic polyester; and acrylic polymers and polyamides.

However, the fabric described in the above-referenced patents is not readily dyeable to dark shades. Although it is known in the art to selectively dye components of conjugate filaments, the ease with which such dyeing may be accomplished and the depth of shade which may be achieved have not been heretofore adequately addressed. The treated nonwoven of the present disclosure addresses these issues.

SUMMARY

In a preferred embodiment, the present process involves subjecting the microdenier fabric to a degrading treatment, which degrades a portion of one component of the conjugate yarns, and then to dyeing. The degrading treatment, given certain reaction kinetics, removes at least a portion of one component of the conjugate filament. For a polyester/polyamide conjugate, an acid treatment is used to remove at least a portion of the polyamide component. The at least partial removal of the polyamide component, especially on the surface of the fabric, results in a fabric having enhanced dyed appearance. In an alternate embodiment, treatment with a basic solution after the acid treatment may be employed to enhance the hydrophilic nature of the fabric for purposes of enhancing moisture transport.

BRIEF DESCRIPTION OF THE DRAWINGS

The following photographs were taken with a Hitachi Camera, Model VK-C350, after having been magnified through an Olympus BH2 optical microscope. The following photographs are of various fabric cross-sections.

DETAILED DESCRIPTION

The present product is created by subjecting a microdenier fabric comprised of splittable continuous conjugate filaments to a degrading treatment and to dyeing. The resultant treated fabric has enhanced ability to be dyed a dark shade, as compared with the untreated fabric and other fabrics made of similar synthetic materials. Further, brighter hues may be produced, and washfastness of dark shades is improved.

The present process includes the steps of: (a) treating the microdenier fabric with a degrading solution and rinsing; and (b) dyeing the treated fabric. Optionally, the microdenier fabric may also be treated with a second degrading solution that targets the second fiber component, if so desired to enhance the moisture transport characteristics of the fabric. The fabric may also be scoured.

The term "polyamide" is intended to describe any long-chain polymer having recurring amide groups (—NH—CO—) as an integral part of the polymer chain. Examples of polyamides include nylon 6; nylon 6,6; nylon 11; and nylon 6,10.

The term "polyester" is intended to describe any long-chain polymer having recurring ester groups (—C(O)—O—). Examples of polyesters include aromatic polyesters, such as polyethylene terephthalate (PET), polybutylene terephthalate (PBT), and polytrimethylene terephthalate (PTT), and aliphatic polyesters, such as polylactic acid (PLA).

Figure 1:
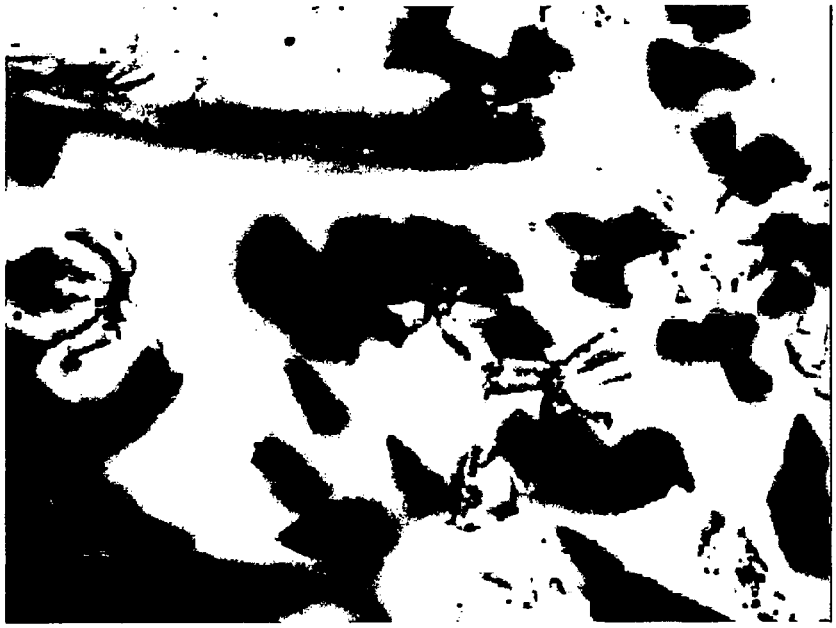
FIG. 1 is a photograph, taken by an optical microscope at a magnification of 975X, of a nonwoven fabric comprised of splittable conjugate yarns that has been dyed but not subjected to the present process.

In one embodiment, the conjugate filaments present, in cross-section, a configuration of zones representing the cross-sections of the different elementary filaments in the form of wedges or triangular sections. FIG. 1 shows a circular fiber cross-section having dark wedges positioned between narrower, light-colored wedges or bands. In this photograph, the dark wedges represent the dyed polyester component of the conjugate filament, while the narrower, lightly colored wedges represent the polyamide component of the conjugate filament. In the example shown, the percentage of polyester in the conjugate filament is larger than the percentage of polyamide. Distributions of polyester to polyamide range from 95–5 to 5–95, with more common distributions being in the 80–20 to 50–50 range, and a distribution of 65–35 being shown in FIG. 1.

A review of FIG. 1 shows a plurality of dark polyester wedges that have been dislodged from their multi-component "packages." In the center portion of the photograph is a circular package, comprised of light-colored polyamide wedges and dark-colored polyester wedges, in which some polyester wedges have been dislodged, but the polyamide skeleton remains largely intact. A similar structure, but with more polyester wedges removed, is visible in center and right and left edges of the photograph. In these cases, the polyamide skeleton appears distorted, as though it were folding onto itself.

Several items should be noted, upon review of this representative photograph of the fabric's composition. First, while the core portions of the conjugate filaments are shown as polyamides, fibers having cores made of polyester could also be used. In fact, fibers having no core portion (that is, hollow core conjugate filaments) and fibers without a recognizable "core" are suitable for use in the present process as well.

Second, it should be noted that FIG. 1 is a photograph of a dyed piece of untreated nonwoven fabric. The fabric shown in FIG. 1 was processed as described above, by extruding a web and then consolidating the filaments of the web. The fabric was then subjected to the conditions of the present process, but without the addition of the degrading treatment. That is, the fabric was tumbled in a jet dye machine for 30 minutes at 130° C., cooled, rinsed, and then dyed.

Finally, the photograph (FIG. 1) shows a symmetrical cross-section of the conjugate filament, having a central median axis. In fact, the median axis of the conjugate filament can be positioned at a point other than the central line of the filament. The conjugate filament can be unsymmetrical, having elementary filaments with non-uniform cross-sections. The cross-section of the conjugate filaments can be substantially circular in shape or can be comprised of multiple lobes that are joined at a central region. Another variation of the construction of splittable conjugate filaments are those having a cross-section in which ribbons, or fingers, of one component are positioned between ribbons, or fingers, of a second different component. Yet another variation includes either one or a plurality of elementary filaments of one material that are integrated in a surrounding matrix of a second different material.

Figure 2:
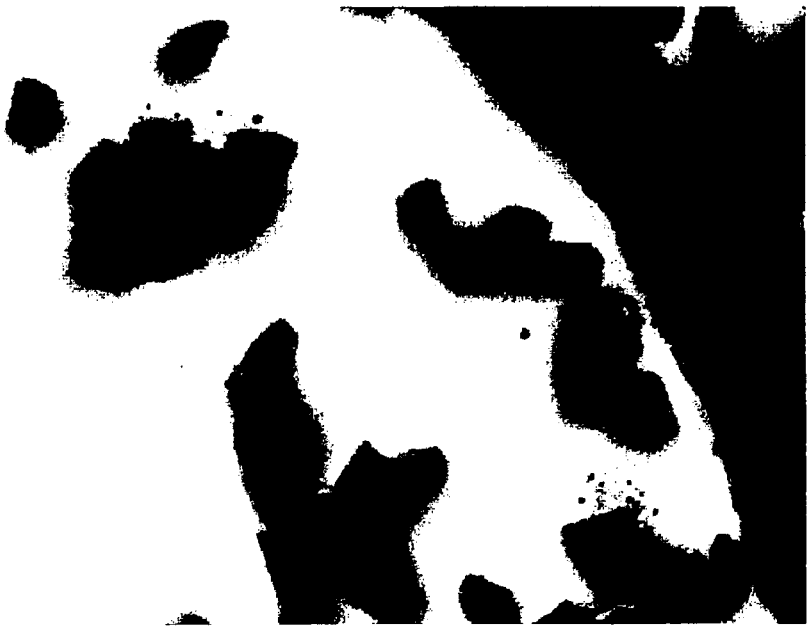
FIG. 2 is a photograph, taken by an optical microscope at a magnification of 975X, of the surface fibers of a nonwoven fabric comprised of splittable conjugate yarns that has been subjected to the degrading treatment of the present process and then dyed.

FIG. 2 is a photograph of a dyed and degraded nonwoven fabric, which has undergone the present process. In FIG. 2, a plurality of polyester wedges is visible, but very few remaining polyamide portions may be identified. This photograph shows the successful degradation of the polyamide fibers through use of the present process. It should be understood that the acid-containing degrading solution described herein may be useful on fibers other than polyamides, while the degrading solution can be modified for use on other fiber types (e.g., a basic solution that is useful on aliphatic and/or aromatic polyesters). The spirit and scope of the present disclosure involves the degradation of at least one fiber component with a degrading solution compatible for the fiber to be degraded.

It is understood in the art that polyamides, such as nylon, can be etched—that is, partially degraded—by subjecting such fibers to acidic solutions. One example of an etching treatment is found in U.S. Pat. No. 4,353,706 to Burns, Jr. et al., which is commonly owned and is hereby incorporated by reference. While the objective of Burns, Jr. et al. is to produce a sculptured pile fabric, the object of the present process is to produce a fabric that has enhanced dyed appearance.

Due to the dissolution of at least some of the polyamide components of the fabric, the resulting fabric has a decreased weight, typically from about 2% of the weight up to the weight of the component to be removed (e.g., 35% in a 65–35 polyester-polyamide conjugate). The resulting fabric also has improved dyed appearance, due to the removal of at least a portion of the polyamide component, which tends to whiten the overall appearance of the dyed (untreated) article. This will be discussed in further detail herein, especially in reference to Table 5.

Both strong and weak acids are useful in the present process, as they both show a preferential affinity for the polyamide components. Examples of common strong acids include sulfuric, phosphoric, nitric, and hydrochloric acids. Weak acids may also be employed in the present process including, but not limited to, organic acids, such as formic acid, and sulfonic acids, such as benzene sulfonic acid; naphthalene sulfonic acid; ortho-, meta-, and para-toluene sulfonic acids; and alkylated aromatic sulfonic acids wherein the alkyl group may be a straight chain or a branched chain and may contain from one to about 20 carbon atoms. Preferably, the weak acids useful in the present process have a $pK_A$ value of from about −5.0 to about 5.0, preferably from about 0.4 to about 1.0. More preferably, paratoluene sulfonic acid (PTSA) is often used for the present process, because of the relative ease with which its corrosive properties may be controlled.

To determine the necessary reaction conditions, one must consider the kinetics and diffusion processes involved in the reaction. In general, the reaction rate is affected by the mass transport rate of the acid reactant to the polymer, the reaction rate of the reactant with the polymer, and the mass transport rate of the degraded polymer out of the fiber matrix. The introduction of phase transfer catalysts, which transfer reactants from the liquid interface into the polymer, can also affect the reaction rate. The reaction rate, therefore, is generally proportional to the concentration of acid reactant, the concentration of the polymer reactant, the temperature during the reaction, and the presence of any catalyst. The mass transport rate of the reactants is largely affected by the concentration of the reactant, the temperature, and the rate of liquid movement during the reaction process. The mass transport rate of degraded polymer is affected by the concentration of degraded polymer, the temperature, and the rate of liquid movement during the reaction process. These parameters can be used to help create a more surface-selective degradation.

A wide range of concentrations has been found to accomplish the objective of the present process (that is, the removal of at least a portion of the polyamide component). The degree of polyamide removal impacts the depth of color that may be achieved in the resultant product. For this reason, it is desirable to remove at least 5% of the polyamide and preferably more than at least 20% of the polyamide. To achieve this degree of polyamide removal, PTSA concentrations varying from 0.40% of the weight of the bath (owb) to about 26% owb may be used, depending on reaction parameters such as application method, exposure time, and temperature. TABLES 1 through 4 indicate the impact of these parameters on polyamide removal.

A particularly effective range of concentrations, when using PTSA, are concentrations greater than about 4.0% of the weight of the bath (owb), though improvements in dyed appearance have been realized with concentrations as low as 0.40% owb. More preferably, when using PTSA, the range is from about 1% to about 10%, based on the weight of the bath. Most preferably, when using PTSA, the acid concentration is from about 4.0% to about 7.0%, based on the weight of the bath. Obviously, different concentrations may be desirable for different acid types, such as organic or strong.

Exposure times, again using PTSA, can range upwards from about 10 minutes to about 120 minutes. The preferred exposure time is about 30 minutes, when a PTSA concentration of from about 4.0% owb to about 7.0% owb is used. Strong acids or higher acid concentrations would likely require a shorter exposure time, while organic acids might need longer periods over which to effect the desired fiber modifications.

In the TABLES, the term "liquor concentration" is intended to describe the weight of the bath relative to the weight of the fabric.

TABLE 1 shows the degree of polyamide removal (that is, % nylon removed) when the acid treatment was applied to the fabric in a jet. In a preferred embodiment, the acid treatment step is conducted in a jet-dyeing machine, into which the fabric is fed, along with an acid solution containing PTSA. The particular jet-dyeing machine that was utilized in these trials was a Werner Mathis AG Jet Dye Machine, Typ-Nr. JF3176. The temperature of the bath is raised to approximately 130° C. and held for a typical exposure time of about 30 minutes. It is believed that temperatures as high as 150° C. would also be acceptable and that reaction times as long as 120 minutes may be used. After the necessary time, the fabric is cooled, preferably to at least 60° C. It is then rinsed, preferably twice, with water to fully remove any trace amounts of the acidic solution.

Use of a jet system is preferred as an application method, because of the quantity of fabric that may treated in one cycle and because of the integration of jet dyeing equipment with other manufacturing processes. In the jet application method, the preferred concentration of PTSA ranges from about 4% to about 10%. The preferred exposure times range from 15 minutes to about 90 minutes (not shown), with 30 minutes being most preferred.

TABLE 1

Application Method: Jet
Treated with PTSA; 130° C.

| Sample ID | Acid concentration (% owb) | Liquor concentration | Acid exposure time (minutes) | % weight loss of sample | % nylon removed |
|---|---|---|---|---|---|
| Sample 1 | 4 | 62.5 | 30 | 11.4 | 32.6 |
| Sample 2 | 5.5 | 36.23 | 30 | 15.9 | 45.4 |
| Sample 3 | 5.5 | 71.94 | 30 | 19.9 | 56.9 |
| Sample 4 | 10 | 25.5 | 15 | 27.8 | 79.4 |
| Sample 5 | 7 | 60.4 | 30 | 28.0 | 80.0 |
| Sample 6 | 7 | 68.49 | 30 | 28.1 | 80.3 |

TABLE 2 shows the degree of polyamide removal (that is, % nylon removed) when the acid treatment was applied to the fabric in a "pot" application. In this embodiment, useful primarily in small batches, the acid treatment step is conducted in a small reaction vessel, into which the fabric is fed, along with an acid solution containing PTSA. The temperature of the bath is raised to approximately 130° C. and held for a typical exposure time of about 30 minutes. It is believed that temperatures as high as 150° C. would also be acceptable. After the necessary time, the fabric is cooled, preferably to at least 60° C. It is then rinsed, preferably twice, with water to fully remove any trace amounts of the acidic solution and the degraded polymer.

Use of a pot system results in the most significant amounts of nylon being removed from the fabric samples. However, because of the small quantity of fabric that may treated in one cycle and because of the lack of integration with other manufacturing processes, it is less preferred as an application method. In the pot application method, the preferred concentration of PTSA ranges from about 1% to about 10%. The preferred exposure time is about 30 minutes.

TABLE 2

Application Method: Pot
Treated with PTSA; 130° C.; 10 g samples

| Sample ID | Acid concentration (% owb) | Liquor ratio | Acid exposure time (minutes) | % weight loss of sample | % nylon removed |
|---|---|---|---|---|---|
| Control | 0 | 20 | 30 | 0 | 0 |
| Sample 7 | 1 | 20 | 30 | 2.6 | 7.4 |
| Sample 8 | 4 | 20 | 30 | 21.2 | 60.6 |
| Sample 9 | 5.5 | 20 | 30 | 28.3 | 80.9 |
| Sample 10 | 10 | 20 | 30 | 31.3 | 89.4 |

TABLE 3 shows the degree of polyamide removal (that is, % nylon removed) when the acid treatment was applied to the fabric in a pad-and-steam operation. In this embodiment, the acid treatment step is conducted by padding the fabric with an acid solution and then subjecting the soaked fabric to steam. The padding step typically occurs at a pressure of about 40 pounds per square inch (p.s.i.). The soaked fabric is then subjected to steam, typically at a temperature of about 214 F. and a pressure of about 30 p.s.i. It is then rinsed with water, neutralized with a 0.5% base solution, and then rinsed again, to fully remove any trace amounts of the acidic solution.

Use of a pad application method may be preferred under some circumstances. In the pad application method, the preferred concentration of acid ranges from about 15% to about 26%. The preferred exposure times range from 10 minutes to about 30 minutes, with 30 minutes being most preferred. In one trial (Sample 12), sulfuric acid was used instead of paratoluene sulfonic acid (PTSA).

TABLE 3

Application Method: Pad/Steam
Treated with acid; padded at 40 psi; steamed at 214° F. and 30 psi

| Sample ID | Acid concentration (% owb) | Acid type | Acid exposure time (minutes) | % weight loss of sample | % nylon removed |
|---|---|---|---|---|---|
| Sample 11 | 26% | PTSA | 10 | 2.3 | 6.6 |
| Sample 12 | 15% | $H_2SO_4$ | 10 | 2.4 | 6.9 |
| Sample 13 | 26% | PTSA | 30 | 3.4 | 9.7 |
| Sample 14 | 26% | PTSA | 30 | 18.0[1] | 51.4 |

[1]Sample 14 was subjected to a low pressure pad technique, rather than the 40 psi referenced above.

Following acid treatment, the fabric may then be subjected to a basic treatment to enhance the fabric's water absorbency. The basic solution reacts with the polyester component of the conjugate filament, making it more hydrophilic. The term "basic solution" is intended to describe a solution containing amines or any of the hydroxides of an alkali or alkaline earth metal. The preferred basic solutions are sodium hydroxide (NaOH) and potassium hydroxide (KOH), with sodium hydroxide being more preferred because of cost. Amines could also be used, although these are less preferred because of their tendency to react with the entire fiber rather than the surface of the fiber.

The preferred concentration for the basic solution is significantly less than that of the acidic solution. In fact, a concentration range from about 0.025% to about 0.10% (based on the weight of the bath) is sufficient to create the desired modifications in the polyester components. Preferably, the concentration of the basic solution is about 0.050% based on the weight of the bath. It has been found that higher concentration levels in the basic solution result in a significantly weakened fabric. Additionally, the fabric tends to lose its textile quality and resemble a paper-type product.

Exposure times, using sodium hydroxide, can range from about 15 minutes to about 90 minutes. The preferred exposure time is about 30 minutes, when a 0.050% owb concentration of sodium hydroxide is used. The base selectively targets the polyester components of the fabric and, specifically, the ester groups. The base hydrolizes the ester bonds in the polyester, creating hydrophilic cites. These cites make the polyester more hydrophilic and the surface of the polyester becomes more water-loving.

The present process is directed to a microdenier fabric having conjugate yarns that is treated with acid and then dyed; however, it is contemplated that the addition of a basic treatment (as described above) may be desired in certain applications. The increased hydrophilicity of the acid and base-treated fabric may be desirable, where increased absorbency is an object.

TABLE 4 shows the degree of polyamide removal (that is, % nylon removed) when the acid treatment was applied to the fabric in a jet and then followed with treatment with a basic solution. In this embodiment, the acid treatment step and the base treatment step are each conducted in a jet-dyeing machine, into which the fabric is fed, along with the respective solution. The temperature of each bath is raised to approximately 130° C. and held for a typical exposure time of about 30 minutes. It is believed that temperatures as high as 150° C. would also be acceptable for the acid treatment step. After each cycle, the fabric is cooled, preferably to at least 60° C. It is then rinsed, preferably twice, with water to fully remove any trace amounts of the treatment solutions.

Use of both an acidic treatment and a basic treatment result in a fabric having not only enhanced dyed appearance, but also improved moisture transport, as compared with untreated fabrics. Such features may be desirable in certain applications, whereas the acid treatment and dyeing will likely be sufficient for most applications. In the case of Samples 15 and 16, PTSA was used to create the acidic solution, while sodium hydroxide was used to create the basic solution. As is demonstrated by comparison of Samples 15 and 16, a wide range of acid concentrations is acceptable to effect the desired loss of polyamide. As will be appreciated by those of skill in the art, longer exposure times are often necessary with lower concentrations.

TABLE 4

Application Method: Jet with Subsequent Base Treatment
Treated with PTSA at 130° C.; Treated with NaOH at 130° C.

| Sample ID | Acid conc. (% owb) | Liquor conc. | Acid Exposure Time | Base conc. (% owb) | Base exposure time | % weight loss |
|---|---|---|---|---|---|---|
| Sample 15 | 0.40 | 108.70 | 90 min. | 1 | 30 | 13.0 |
| Sample 16 | 5.50 | 285.7 | 30 min. | 1 | 20 | 17.0 |

After treating with acid, and optionally base, the non-degraded fiber component of the fabric is then dyed using conventional dyeing techniques. Disperse dyes have been found most effective, though vat dyes may also be used. One particularly beneficial effect of the acid treatment is an overall improvement in the ability of the fabric to be dyed a dark shade. This improved dyed appearance is attributable to the decrease in the amount of polyamide present in the fabric. Deeper shades of color are achieved when the polyamide components of the fabric have been (at least partially) removed.

The fabric is fed into a jet-dyeing machine along with a dye mix solution, preferably containing disperse dyes for the polyester component. Dyeing in conventional jet-dyeing equipment typically occurs at a temperature of about 130° C. over a cycle time of from about 30 minutes to about 90 minutes. Once dyed, the fabric is then cooled (again to at least 60° C.) and then rinsed twice to ensure that all trace chemicals have been removed. To improve dyefastness, a scouring step may be employed to remove poorly adhered dyestuff from the fabric, according to techniques known in the art. Common scouring agents include sodium hydrosulfite, thiourea dioxide, or dilute caustic solutions.

Other finishing chemicals can be applied to the treated fabric, including soil release agents, wetting agents, and hand-building agents. Such chemicals are effectively applied in a padding operation, although other application techniques may be employed. These agents can improve the hand and soil release characteristics of the fabric, without negatively impacting the fabric's ability to be dyed.

Due to the dissolution of at least some of the polyamide components of the fabric, the resulting fabric has a decreased weight, typically from about 2% of the weight up to the weight of the component to be removed (e.g., 35% in a 65–35 polyester-polyamide conjugate). The resulting fabric also has improved dyeing characteristics, due to the removal of at least a portion of the polyamide component, which tends to whiten the overall appearance of the dyed (untreated) article. This is discussed in further detail below in TABLE 5.

TABLE 5 shows a comparison of various samples, as tested by an X-Rite SP78 Spectrophotometer using Hammermill IJ Paper White as a standard. The equipment measures an "L," an "a," and a "b" value to quantify the surface coloration of the sample. "L" is a measure of the amount of white or black in a sample; higher "L" values indicate a whiter sample. "A" is a measure of the amount of red or green in a sample, while "B" is a measure of the amount of blue or yellow in a sample. Because "a" and "b" are highly dependent on the dye color used, those values were not deemed significant for understanding the impact of the present process.

As shown in TABLE 5, the "L" value of the samples decreases as more polyamide (nylon) is removed. Darker fabrics have lower "L" values, while higher "L" values indicate a whiter sample. The "L" values shown in TABLE 5 indicate the removal of whiteness from the samples, resulting in fabrics having darker shades than those achieved with untreated fabric (see "Control").

The samples are given the same identification numbers as listed in TABLES 1–4 for reference. The control, Sample 1, Sample 3, and Sample 6 were dyed together in the same bath under the same conditions. After dyeing, the samples were found to contain the same amount of dye. This can be explained by the fact that the polyester, which was left undegraded, was targeted by the disperse dyes, while the nylon was degraded.

TABLE 5

| LAB Values<br>Measure of "whiteness" of sample | | | |
|---|---|---|---|
| Sample ID | % weight loss | % nylon removed | "L" value |
| Control | 0 | 0 | 32.23 |
| Sample 1 | 11.4 | 32.6 | 25.97 |
| Sample 3 | 19.9 | 56.9 | 23.99 |
| Sample 6 | 28.1 | 80.3 | 23.79 |

Because the LAB measurements detect color and shade primarily on the surface of the fabric, it should be understood that removal of surface nylon is most important. In fact, in the present process, the amount of nylon on the surface is found to be considerably less than the amount of nylon in the interior portions of the fabric. This finding points out two things: first, the goal of the present process does not require the removal of all (or substantially all) of the nylon; and second, a surface-selective degradation process is preferred to optimize color without eliminating weight or strength.

It has been found that degrading at least one component of the conjugate yarns imparts the desired dyed appearance to the treated fabric. Functionally, the treated fabric, having been partially degraded, is more capable of (a) being dyed to a dark shade; (b) being dyed to a brighter shade; and (c) holding a dark shade during washing. Structurally, the treated fabric contains a plurality of fully split conjugate yarns, having individualized polyester components and degraded individualized polyamide components.

The ability to dye fabric a deep shade is useful in applications including, but not limited to, apparel, automotive, home & office furnishings, hospitality furnishings, and the like.

We claim:

1. A dyed microdenier fabric being comprised of conjugate filaments that have been mechanically separated along their lengths into first elementary filaments and second elementary filaments, said second elementary filaments being of a different filament material than said first elementary filaments, wherein said first elementary filaments are selected from the group consisting of nylon 6, nylon 6,6, nylon 11, and nylon 6,10 and are partially chemically degraded and said second elementary filaments are dyed.

2. The dyed fabric of claim 1 wherein said first elementary filament is nylon 6.

3. The dyed fabric of claim 1 wherein said second elementary filament is selected from the group consisting of polyesters, polyurethanes, polyolefins, and acrylic polymers.

4. The dyed fabric of claim 3 wherein said second elementary filament is a polyester selected from the group consisting of polyethylene terephthalate (PET), polytrimethylene terephthalate (PTT), polybutylene terephthalate (PBT), and polylactic acid (PLA).

5. The dyed fabric of claim 4 wherein said second elementary filaments is polyethylene terephthalate (PET).

6. The dyed fabric of claim 1 wherein said first elementary filament is nylon 6 and said second elementary filament is polyethylene terephthalate (PET).

7. The dyed fabric of claim 1 wherein said fabric is treated with a hand-building agent.

8. The dyed fabric of claim 1 wherein said fabric is treated with a soil release agent.

9. The dyed fabric of claim 1 wherein said conjugate filaments are continuous.

10. A dyed microdenier fabric having outer surfaces and an interior surface, said dyed fabric being comprised of conjugate filaments that have been mechanically separated along their lengths into first elementary filaments and second elementary filaments, said second elementary filaments being of a different filament material than said first elementary filaments, wherein said first elementary filaments are selected from the group consisting of nylon 6, nylon 6,6, nylon 11, and nylon 6,10 and are partially chemically degraded and said second elementary filaments are dyed, and said first filament material is substantially concentrated in the interior surface of said dyed fabric.

11. The dyed fabric at claim 10 wherein said first elementary filament is nylon 6.

12. The dyed fabric of claim 10 wherein said second elementary filament is selected from the group consisting of polyesters, polyurethanes, polyolefins, and acrylic polymers.

13. The dyed fabric of claim 12 wherein said second elementary filament is a polyester selected from the group consisting of polyethylene terephthalate (PET), polytrimethylene terephthalate (PTT), polybutylene terephthalate (PBT), and polylactic acid (PLA).

14. The dyed fabric of claim 13 wherein said second elementary filament is polyethylene terephthalate (PET).

15. The dyed fabric of claim 10 wherein said first elementary filament is nylon 6 and said second elementary filament is polyethylene terephthalate (PET).

16. The dyed fabric of claim 10 wherein said fabric is treated with a hand-building agent.

17. The dyed fabric of claim 10 wherein said fabric is treated with a soil release agent.

18. The dyed fabric of claim 10 wherein said conjugate filaments are continuous.

19. A dyed microdenier fabric having outer surfaces and an interior surface, said dyed fabric being comprised of conjugate filaments that have been mechanically separated along their lengths into first elementary filaments and second elementary filaments, said second elementary filaments being of a different filament material than said first elementary filaments, wherein said first elementary filaments are selected from the group consisting of nylon 6, nylon 6,6, nylon 11, and nylon 6,10 and are partially chemically degraded and said second elementary filaments are dyed, and wherein said second filament material has a substantially wedge-shaped cross-section and a dpf of less than 0.3.

20. The dyed fabric of claim 19 wherein said first elementary filament is nylon 6.

21. The dyed fabric of claim 19 wherein said second elementary filament is selected from the group consisting of polyesters, polyurethanes, polyolefins, and acrylic polymers.

22. The dyed fabric of claim 21 wherein said second elementary filament is a polyester selected from the group consisting of polyethylene terephthalate (PET), polytrimethylene terephthalate (PTT), polybutylene terephthalate (PBT), and polylactic acid (PLA).

23. The dyed fabric of claim 22 wherein said second elementary filament is polyethylene terephthalate (PET).

24. The dyed fabric of claim 19 wherein said first elementary filament is nylon 6 and said second elementary filament is polyethylene terephthalate (PET).

25. The dyed fabric of claim 19 wherein said fabric is treated with a hand-building agent.

26. The dyed fabric of claim 19 wherein said fabric is treated with a soil release agent.

27. The dyed fabric of claim 19 wherein said conjugate filaments are continuous.

28. A dyed nonwoven fabric being comprised of continuous conjugate filaments that have been mechanically separated along their lengths into first elementary filaments and second elementary filaments, said second elementary filaments being of a different filament material than said first elementary filaments, wherein said first elementary filaments are selected from the group consisting of nylon 6, nylon 6,6, nylon 11, and nylon 6,10 and are partially chemically degraded and said second elementary filaments are dyed.

29. The dyed nonwoven fabric of claim 28 wherein said first elementary filament is nylon 6.

30. The dyed nonwoven fabric of claim 28 wherein said second elementary filament is selected from the group consisting of polyesters, polyurethanes, polyolefins, and acrylic polymers.

31. The dyed nonwoven fabric of claim 30 wherein said second elementary filament is a polyester selected from the group consisting of polyethylene terephthalate (PET), polytrimethylene terephthalate (PTT), polybutylene terephthalate (PBT), and polylactic acid (PLA).

32. The dyed nonwoven fabric of claim 31 wherein said second elementary filaments is polyethylene terephthalate (PET).

33. The dyed nonwoven fabric of claim 28 wherein said first elementary filament is nylon 6 and said second elementary filament is polyethylene terephthalate (PET).

34. The dyed fabric of claim 28 wherein said fabric is treated with a hand-building agent.

35. The dyed fabric of claim 28 wherein said fabric is treated with a soil release agent.

* * * * *